US007578708B2

(12) United States Patent
Hachadorian

(10) Patent No.: US 7,578,708 B2
(45) Date of Patent: Aug. 25, 2009

(54) SOCKET AND METHOD FOR ITS PRODUCTION

(75) Inventor: Gary Hachadorian, Roellbach (DE)

(73) Assignee: Erich Jaeger GmbH & Co. KG, Friedberg (DE)

( * ) Notice: Subject to any disclaimer, the term of this patent is extended or adjusted under 35 U.S.C. 154(b) by 0 days.

(21) Appl. No.: 12/046,793

(22) Filed: Mar. 12, 2008

(65) Prior Publication Data

US 2009/0149085 A1 Jun. 11, 2009

(30) Foreign Application Priority Data

Dec. 7, 2007 (DE) ..... 10 2007 059 357

(51) Int. Cl.
*H01R 13/405* (2006.01)

(52) U.S. Cl. ..... 439/736

(58) Field of Classification Search ..... 439/736, 439/620, 752, 753, 754, 874
See application file for complete search history.

(56) References Cited

U.S. PATENT DOCUMENTS 2,229,211 A * 1/1941 Korengold ..... 439/736
3,522,575 A * 8/1970 Johnson et al. ..... 439/281
4,952,169 A * 8/1990 Hayes, Sr. ..... 439/403
5,085,595 A * 2/1992 Koegel et al. ..... 439/494
5,087,212 A * 2/1992 Hanami ..... 439/620.04
5,492,485 A * 2/1996 Drewanz et al. ..... 439/404
5,518,427 A * 5/1996 Kan et al. ..... 439/736
5,749,743 A * 5/1998 Harada et al. ..... 439/336
5,800,188 A * 9/1998 Barber et al. ..... 439/142
6,086,422 A * 7/2000 Glynn ..... 439/620.07
6,315,611 B1 * 11/2001 Sawada et al. ..... 439/619
6,764,351 B2 * 7/2004 Finzer et al. ..... 439/752
6,793,533 B2 * 9/2004 Berg et al. ..... 439/620.04
7,081,012 B2 * 7/2006 Gensert et al. ..... 439/559

* cited by examiner

*Primary Examiner*—T C Patel
*Assistant Examiner*—Harshad C Patel
(74) *Attorney, Agent, or Firm*—McAndrews, Held & Malloy, Ltd.

(57) ABSTRACT

A socket for an electrical plug-and-socket connection is described, comprising a housing, a plug-in opening for mounting a plug, and a contact support insert configured in the housing. The contact support insert comprises contacts extending into the plug-in opening, configured as flat contacts with elastically bent contact surfaces. Preferably, to provide a reliably sealed socket, a first part of the socket housing is formed together with the contact support insert as a single component in a first injection molding step, and the contacts are then fastened into the contact support insert. In a second injection molding step, a second part of the socket housing is then cast onto the first part of the socket housing.

12 Claims, 6 Drawing Sheets

SOCKET AND METHOD FOR ITS PRODUCTION

BACKGROUND OF THE INVENTION

The present technology relates to a socket for an electrical plug and socket connection, comprising a housing, a plug-in opening for mounting a plug, and a contact support insert positioned in the housing. The contact support insert includes contacts extending into the plug-in opening, which are designed as flat contacts with an elastically bent contact surface. The socket is particularly intended as an electrical connection socket between a vehicle and trailer.

This type of socket is known from U.S. Pat. No. 5,873,752, which also serves for electrical connection of a trailer pulled by a vehicle. That patent discloses a unitary socket and contact insert, wherein the contact insert contains flat contacts with elastically bent contact surfaces that are inserted in corresponding openings of the contact support insert. To seal the socket, after the contacts are inserted, the plug-in openings are sealed with a liquid sealant. This method unnecessarily complicates production. Additionally, such sealants are typically not weather resistant. The use of such sealants is therefore undesirable in vehicle applications.

Another type of trailer socket is disclosed in U.S. Pat. No. 5,800,188. In that patent, the contacts are inserted into the socket housing and made fast by a core that presses the contacts against the socket housing, which is inserted into the middle of a circular ring formed by the contacts. That type of design suffers from a drawback in that the area surrounding the inserted core is not sealed against moisture penetration. During operation, electrical leakage or short-circuits can occur. Production is also comparatively expensive, since many individual parts must be separately installed in succession.

SUMMARY OF THE INVENTION

An object of the present technology, therefore, is to provide a sealed socket that can be easily produced, which preferably results in permanent and reliable sealing of the contacts protruding from the contact support insert.

It is believed that this object is met by, for example, a socket according to claim 1 of the present technology, as well as the method for its production according to claim 12.

To achieve this purpose, it is particularly preferred that the socket housing be produced in two consecutive injection molding steps. In a first injection molding step, a first part of the socket housing is formed together with the contact support insert as a single component, and the contacts are then fastened into the housing. In a second injection molding step, a second part of the socket housing is then cast onto the first part of the socket housing.

The contacts, preferably flat contacts with an elastically bent contact surface, would usually be problematic in this type of process. These types of contacts would prevent an injection molding die (which defines the plug-in opening and establishes the contacts during casting) from being pulled out of the plug-in opening after injection molding, since the die that fastens the contacts will typically hook onto the bent contact surfaces. In the presently disclosed two-step injection molding process, it is therefore proposed that the areas around the contacts with the bent contact surfaces preferably not be completely cast in the first injection molding step, and that the socket housing be finished in a second injection molding step.

According to a straightforward first embodiment, the first molded component of the socket housing preferably forms a connection opening and a contact support insert with fixed contacts. The area of the contacts comprising the bent contact surfaces are preferably not enclosed by the first molded component of the socket housing. The second molded component of the socket housing then forms a plug-in opening with a wall of the housing which encloses the area of the contacts comprising the bent contact surfaces. In this type of embodiment, the injection molding die (which fixes the contacts during the first injection molding step) is free and can be laterally removed without complications after injection molding.

In another particularly preferred embodiment, the first component of the housing can form the connection opening, the contact support insert with contacts fixed in it, and also the plug-in opening with fixation openings. A second component of the housing can then be formed, which seals the fastening openings. In other words, according to this embodiment, fastening openings left in the housing after the first injection molding step are sealed in a second injection molding step. The fastening openings in this embodiment preferably permit the contacts to be fastened in the injection molding die during the first injection molding step, and also preferably permit the injection molding die to be loosened after injection molding without destroying the cast component.

Accordingly, it is also preferred according to the present technology that fastening openings are provided in the socket housing wall around the plug-in opening in the first injection molding step. Retaining tools configured as gates can then be provided during the injection molding process, which can fasten the contacts and subsequently be pulled away through the fastening openings. The remaining fastening openings can be later sealed in a second injection molding step. During this second injection molding step, there is no longer a need for the injection molding die to reach behind the bent contact surfaces in the plug-in opening. The injection molding die can therefore be pulled out again from the plug-in molding after the second injection molding step. Additionally, because the preferred contacts of the present technology are cast in the contact support insert of the socket, and the contact support insert and housing are cast as a single part in a single process, production of the socket is relatively straightforward. In addition, because the contact support insert and socket housing are produced as a single component, there are no sealing concerns between these two components. Closing the fastening openings during a second injection molding step can be accomplished with straightforward injection molding dies, without great expense.

It is particularly preferred that the fastening openings be formed on the end of the plug-in opening of the socket in the wall of the surrounding socket housing, i.e., on the bottom of the plug-in opening. Arranging the fastening openings at that point is preferred because it permits fastening the contacts in the injection molding die with straightforward gates that can be subsequently pulled from the socket housing wall.

It is also preferred that each contact correspond to its own fastening opening, so that a fastening tool can be assigned to each contact.

According to a particularly preferred embodiment of the present socket, the contact surfaces of the contacts (as viewed from the center axis of the plug-in opening) are bent outward to the wall of the housing. A gap preferably remains between the end of the contact surface and the bottom of the plug-in opening, with a height that roughly corresponds to the height of the fastening opening. A fastening tool can then be pushed through this fastening opening, which engages in the gap between the end of the contact surface and the bottom of the plug-in opening, and securely forces the contact against a stop formed in the injection molding die. After injection molding, the fastening tool can then be pulled outward again.

In another embodiment of the present technology, the same type of material used to mold the housing and contact support insert in the first injection molding step can be introduced into the fastening openings in the second injection molding step. Therefore, the material introduced in the second injection molding step preferably bonds particularly well with the material of the socket housing and reliably seals the fastening openings. In addition, it is desirable to use only one injection molding compound during production.

According to an alternative embodiment of the present invention, a rubber-elastic material can also be introduced to the fastening openings during the second injection molding step, in order to reliably seal them.

The rubber-elastic material can also simultaneously form an axial seal, which seals the contacts in the plug-in opening relative to a plug inserted into the plug-in opening. The second injection molding step can therefore be used to form this seal arranged in the plug-in opening, which otherwise would have to be set into the plug-in opening in an additional production step. Without the provision of such a seal, water could enter the contact area of the socket (especially near the vehicle) and lead to electrical leakage, short circuits or other defects in the electrical connection.

According to a particularly preferred embodiment, the axial seal extends from the fastening opening (as one component) along the wall of the plug-in opening. The end of the seal forms a sealing surface opposite the fastening opening, which can cooperate with a plug inserted into the socket. In this embodiment, the axial direction is firmly connected in sealed fashion to the socket housing. Therefore, only one sealing surface is required to protect the contact space of the socket against moisture penetration when a plug is inserted. A socket according to this type of embodiment, therefore, is protected particularly well against moisture penetration into the contact space.

In order to achieve a defined pressure of the sealing surface against a plug inserted into the socket, and also to allow the seal to be axially adjusted, the seal can be provided with at least two V-shaped extensions between the fastening opening and the sealing surface. These V-shaped extensions may be adjusted in a bellows-like fashion when a plug is mounted in the socket, and permit movement of the seal or sealing surface in the axial direction.

The present technology also relates to a method for production of the above-described socket, wherein the housing and contact support insert are cast in an injection molding process. In a preferred embodiment, the injection molding process includes two injection molding steps. In the first injection molding step, one part of the housing and the contact support insert are cast as a single component, and flat contacts with bent contact surfaces are cast into the contact support insert. In the second injection molding step, a second part of the housing is molded onto the first part of the housing. This type of process allows one to remove the injection molding die after the first injection molding process without interference from the contacts.

Additionally, in the first injection molding step, the first part of the housing (preferably the part forming a connection opening and the contact support insert) can be cast. In the second injection molding step, the second part of the housing (the part forming a plug-in opening) can be cast. The second part of the housing (the part that forms the plug-in opening) can enclose the contacts in the area of the bent contact surfaces.

According to a more preferred embodiment of the proposed method, a first part of the socket housing is cast, comprising the connection opening, the contact support insert, and the plug-in opening. Fastening openings are left in the plug-in opening or the wall of the socket housing encasing the plug-in opening. These fastening openings are then sealed in a second injection molding step (i.e., the sealant for the fastening openings forms the second part of the socket housing). This method preferably allows contacts with bent contact surfaces to be produced in a single injection molding process (i.e., socket and contact insert together), and thus achieve simple production and reliable sealing of the socket.

Preferably, the contacts in the above-described embodiment are fixed in the first injection molding step, via gates in an injection mold. The gates extend through the fastening openings in the wall of the socket, out of the plug-in opening, and removed in a longitudinal direction from the fastening openings after the first injection molding step.

In another particularly preferred embodiment of the socket, six flat contacts are arranged in a circle. Three gates can each be arranged parallel to each other, and are preferably movable in the same direction (preferably together). In this embodiment, the pressure surfaces of the gates (with which the contacts are fixed in the injection mold) are correspondingly beveled. Coordinated movement of the three gates, therefore, simplifies the production process, since three contacts can be fixed by a single movement process in the injection mold.

Also in a particularly preferred embodiment, a seal (preferably made of rubber-elastic material) can be injected in a second injection molding step. The seal preferably both simultaneously closes the fastening opening, and also forms a seal within the plug-in opening for sealing the socket relative to a plug inserted in the plug-in opening.

Additional advantages, features and application possibilities of the present technology are also illustrated by the following Figures and descriptions of specific examples. All described and/or depicted features, alone or in combination, can comprise objects of the present technology, independently of their description in the claims and/or other descriptions in the specification.

DETAILED DESCRIPTION

Figure 1:
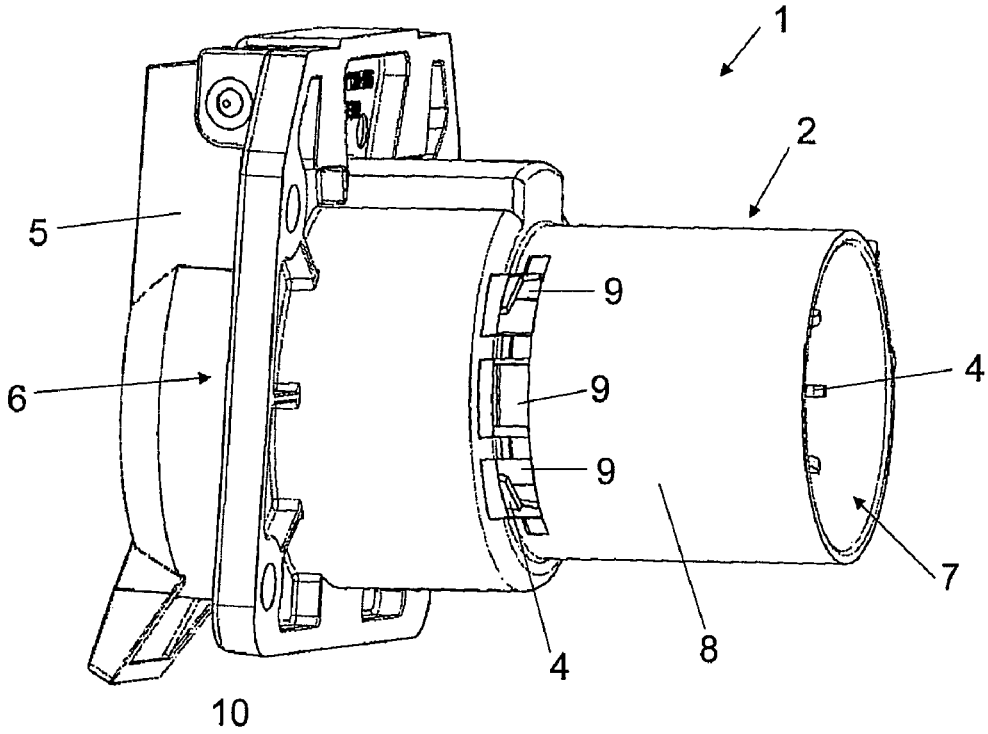
FIG. 1 illustrates a first embodiment of the presently disclosed socket in a three-dimensional side view with open fastening openings.

FIG. 1 illustrates an exemplary socket with a housing 2, provided as a single component with a contact support insert 3 arranged within the housing 2, in which contacts 4 (formed as flat contacts) are established by molding. A cover 5, attached to the housing 2, is provided on socket 1, and closes a plug-in opening 6 of socket 1. A connection opening 7 is formed in an axial direction on the side of the socket 1, opposite the plug-in opening 6. The contacts 4 of the socket 1 each extend into the plug-in opening 6 and the connection opening 7.

Near the plug-in opening 6, fastening openings 9 are provided in the wall 8 of the housing 2, through which a gate (not shown) can be inserted up to the contacts 4.

FIG. 1 illustrates the housing 2 after the first injection molding step, wherein the housing 2 and the contact support insert 3 (with contacts fixed in it) are molded as a single component. The cover 5 of the socket 1 is later fastened to the housing 2.

Figure 2:
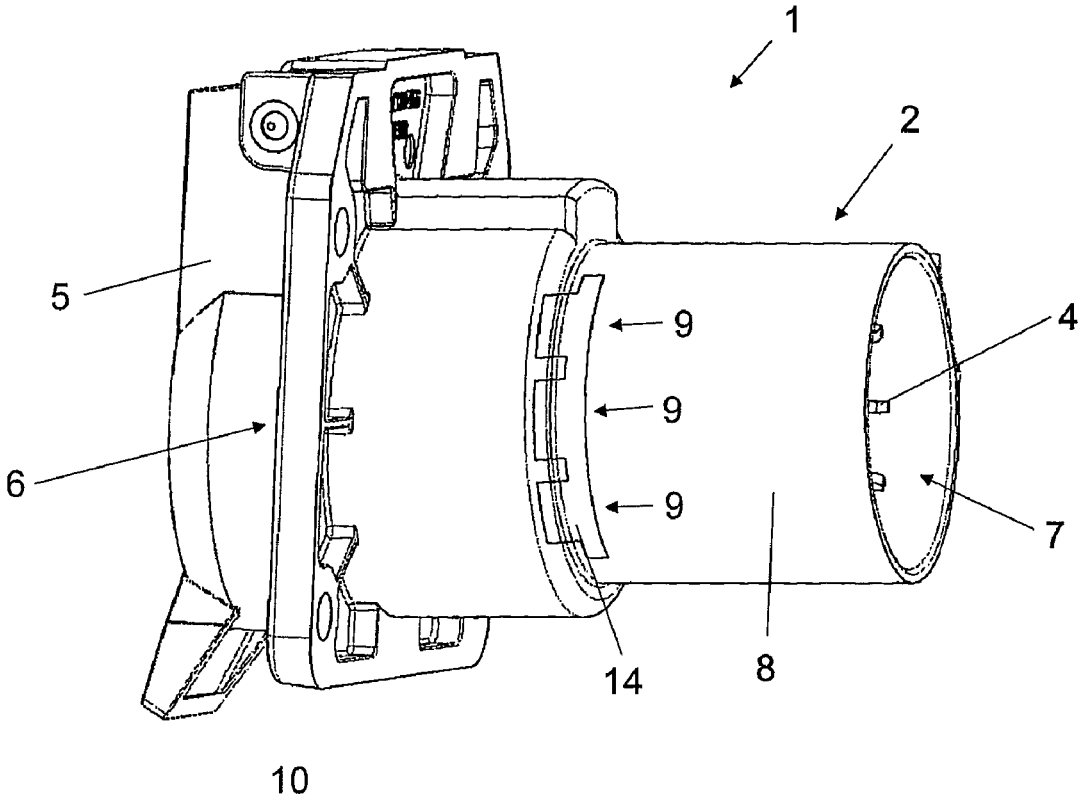
FIG. 2 illustrates a socket according to FIG. 1 with closed fastening openings.

FIG. 2 illustrates the socket 1 and the housing 2 after a second injection molding step, wherein the fastening openings 9 are sealed by injection of an appropriate injection molding material 14. For this purpose, the same injection molding material 14 that was used to form the housing 2 and the contact support insert 3 can be used. Additionally, the socket 1 is provided with a fastening flange 10 around the open edge of the plug-in opening 6.

Figure 3:
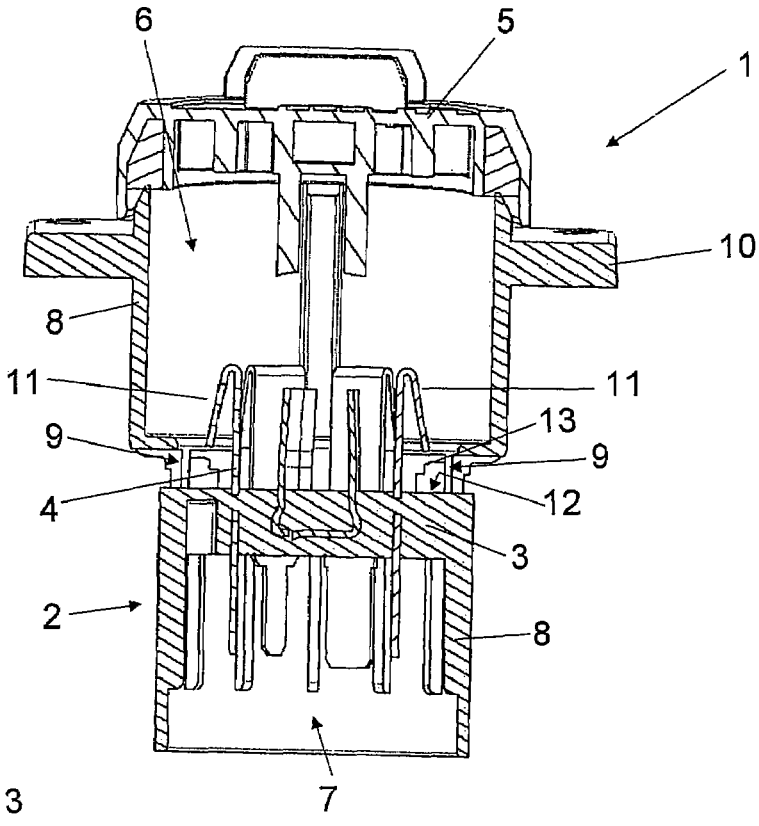
FIG. 3 illustrates a longitudinal section through the socket of FIG. 1.
Figure 4:
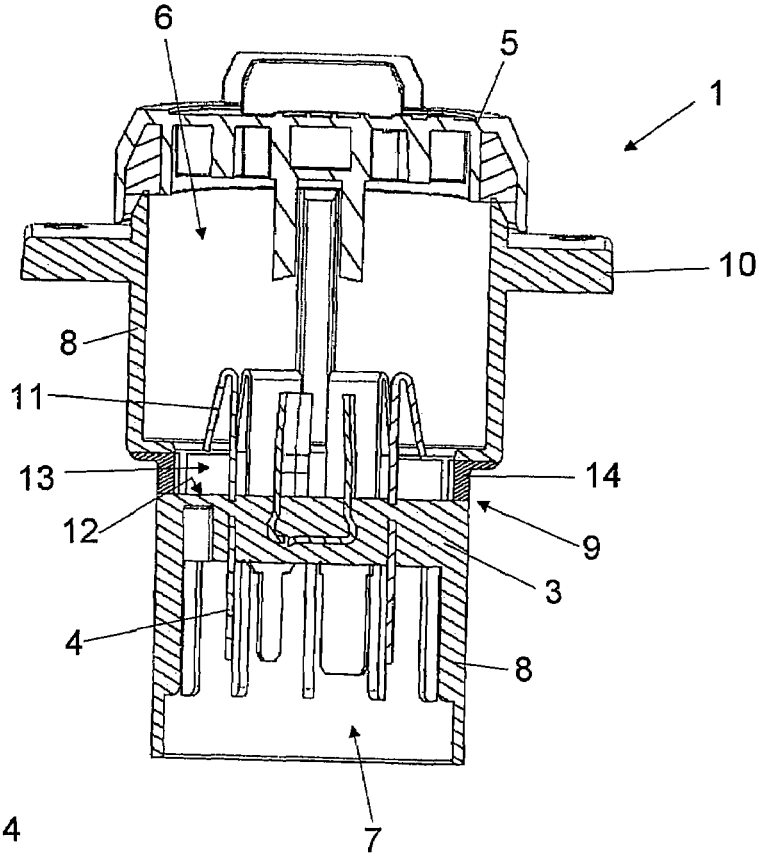
FIG. 4 illustrates a longitudinal section through the socket of FIG. 2.

The design of the above-discussed embodiment of the socket 1 of the present technology can also be explained by reference to the section drawings of FIG. 3 and FIG. 4, which show the socket housing 2 after the first injection molding step (FIG. 3) and the second injection molding step (FIG. 4).

As can be seen from the sectional drawing in FIG. 3, the contact support insert 3 and the wall 8 of the housing 2 can form a single component molded in the first injection molding step. The contacts 4 of the socket 1 can be molded in the contact support insert 3 during the first injection molding step. The contacts 4 can each extend into the plug-in opening 6 for electrical connection with a plug, which can be inserted into socket 1 and the connection openings 7 to connect, for example, the electrical system of a vehicle. This embodiment would also comprise production of appropriate plug connections.

The contacts 4 in this embodiment can be designed as flat contacts which form an elastically bent contact surface 11 in the plug-in opening 6. The contacts 4 can be bent outward toward the wall 8 of the housing 2, when viewed from the center axis of the plug-in opening 6. Between the end of the contact surface 11 and the bottom of the plug-in opening 12, a gap 13 can be provided. The height of the gap can correspond to the height of a fastening opening 9 arranged in front of the gap 13. This configuration allows a gate (not shown) to be advanced through the fastening opening 9 up to the contact 4. The gate can preferably fix the contact 4 in the injection mold during the first injection molding step. Accordingly, the injection molding can form a core positioned in the later plug-in opening 6 of the socket 1. Preferably, the core is positioned in the center of the plug-in opening, abutting the inner surfaces of the contacts 4. The contacts 4 can be fixed against this core by the gates, which can be inserted through fastening openings 9. A configuration of this type allows the housing 2 and the contact support insert 3 to be produced in one part in one injection molding step, and at the same time, allows the contacts 4 to be fixed into the contact support insert. The gates can then also be pulled out to the side from the fastening openings 9 after the first injection molding step, without hooking on the bent contact surfaces 11 of the contacts 4. These contact surfaces 11 would normally prevent the injection molding die used to fix the contacts 4 from being removed through the plug-in opening 6 after injection molding.

Moreover, in this embodiment, after the housing 2 of socket 1 is produced in the first injection molding step (as shown in FIG. 3), the fastening openings 9 can be closed in a second injection molding step. Preferably, the same injection molding material 14 that was used to produce the housing 2 and a contact support insert 3 is used to close the fastening openings 9. In the interior of the plug-in opening 6, the injection molding die can be configured to form an injection mold that is formed sleeve-like around the contacts 4. Therefore, this die can be easily removed from the plug-in opening 6 after the injection molding process.

A second embodiment of the presently described invention includes a socket 21, which is described by reference to FIGS. 5-9. This embodiment is similar in principal to the above-described embodiment. In particular, features described with regard to the second embodiment can also be utilized in the first embodiment described in FIGS. 1-4, or vice-versa.

In this second embodiment, the socket 21 has a housing 22 and a contact insert 23 (in which contacts 24 are provided) that are produced as a single component in one injection molding step.

A cover 25 (which is subsequently fastened to the housing 22 of the socket 21 in the unused state) preferably covers a plug-in opening 26 of socket 21. The plug-in opening 26 can mate with, for example, a plug of a trailer, in order to electrically connect the trailer. A connection opening 27 is provided relative to the plug-in opening 26. In this embodiment, the connection opening is not round, in contrast to the previous embodiment, but is rectangular, in order to mate with a rectangular connection plug.

In the fastening section 33 of the plug-in opening 26, fastening openings 29 are formed in the wall 28 of the housing 22, through which a gate of an injection molding die (not shown) can be pushed up to the contacts 24. This is further explained below.

Figure 5:
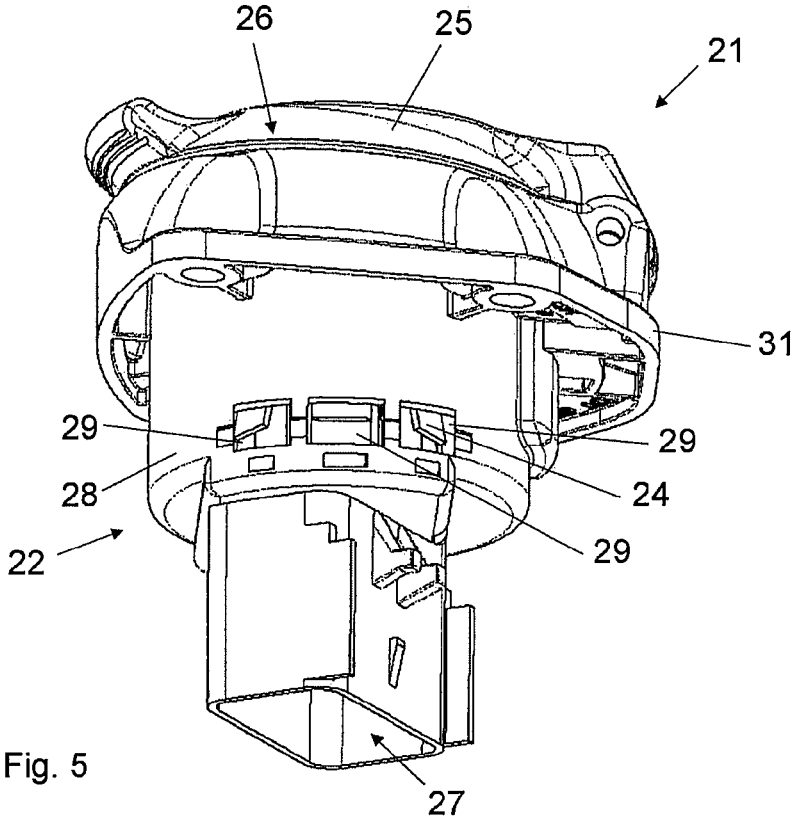
FIG. 5 illustrates a second embodiment of the presently disclosed socket in a three-dimensional side view with open fastening openings.
Figure 6:
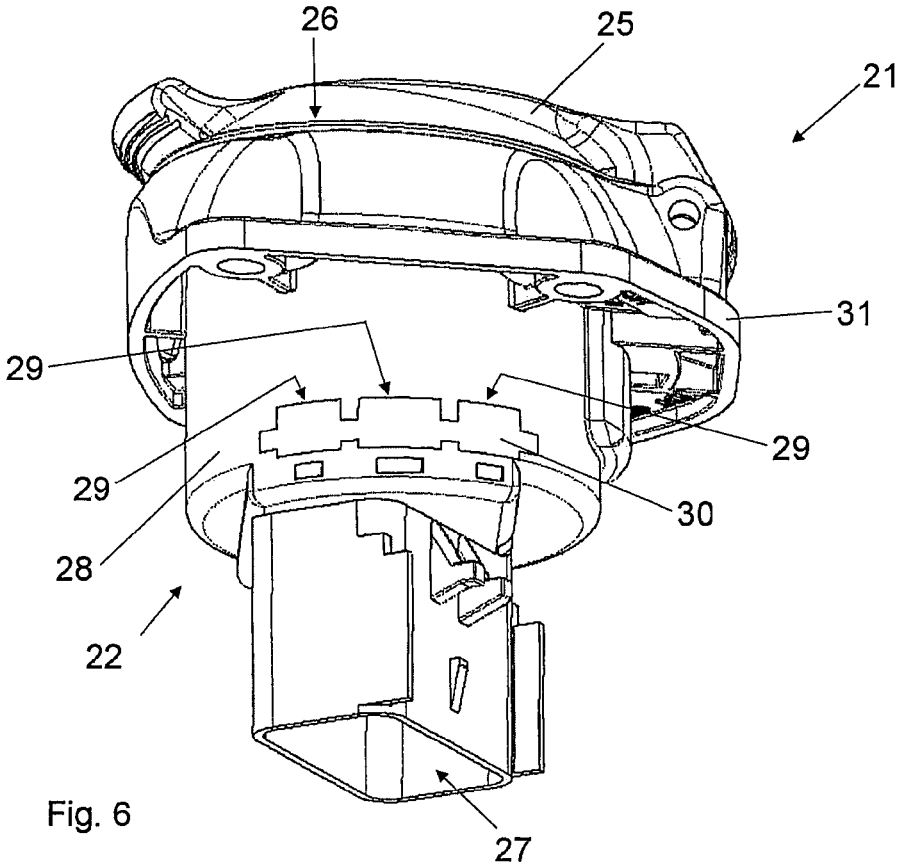
FIG. 6 illustrates the socket of FIG. 5 with closed fastening openings.

FIG. 6 illustrates the socket 21 of FIG. 5, wherein the fastening openings 29 are sealed with a rubber-elastic material that is introduced into the fastening openings 29 in a second injection molding step.

A fastening section 31 is configured around the plug-in opening 26, which can be used to screw the socket 21 onto a fastening surface (not shown).

Figure 7:
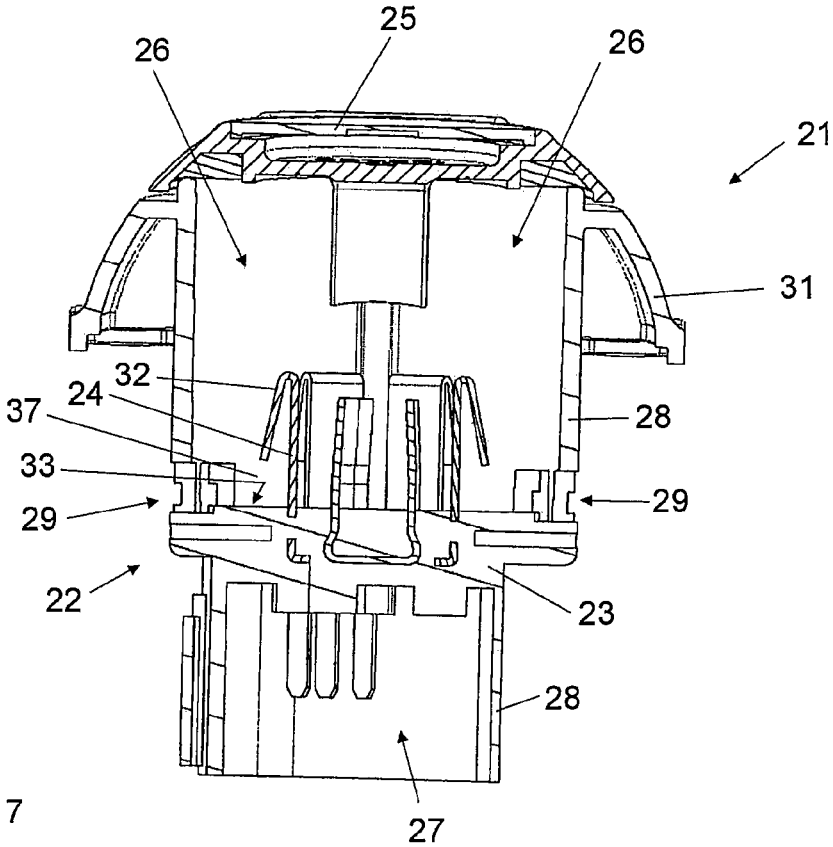
FIG. 7 illustrates a longitudinal section through the socket of FIG. 5.
Figure 8:
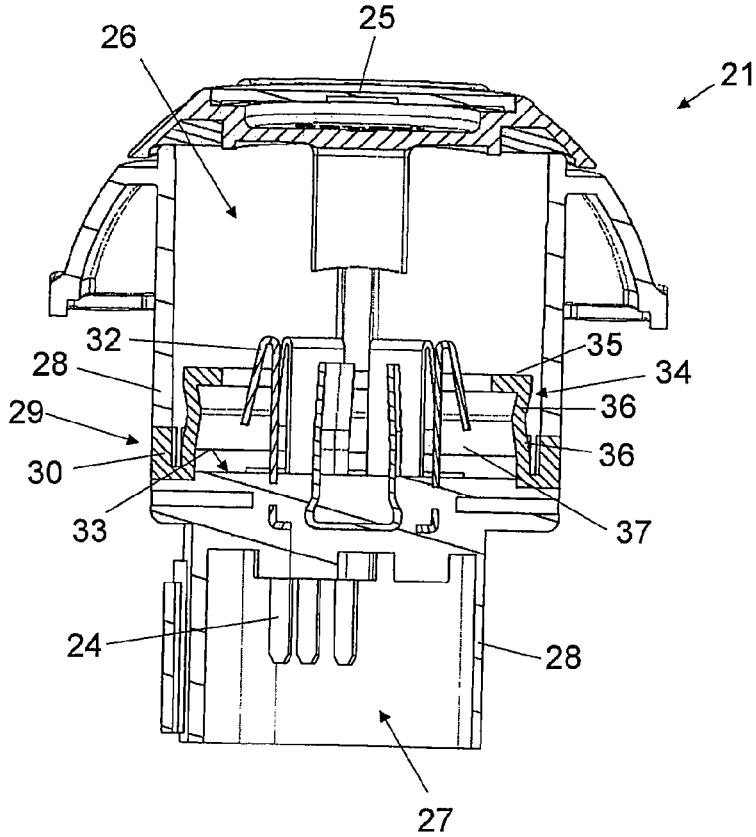
FIG. 8 illustrates a longitudinal section through the socket of FIG. 6.

The sectional drawing in FIG. 7 also illustrates the housing 22 of the socket 21, wherein the wall 28 is cast as a single component with the contact support insert 23. During this first injection molding step, the contacts 24 are also fastened in the contact support insert, so that the contacts 24 extend both into the plug-in opening 26 and the connection opening 27. The contacts 24, in the plug-in opening 26, have elastically bent contact surfaces 32, between whose ends and the bottom 33 of the plug-in opening 26 a gap 37 is formed, whose height corresponds roughly to the height of the fastening opening 29.

Accordingly a fastening die of the injection molding die can be provided as a gate (not shown) through the fastening opening 21 up to the contacts 24. This gate can force the contacts 24 against a core arranged in the center of the later plug-in opening 26. The injection molding die can then also be simply removed upward after injection molding.

FIG. 7 illustrates the housing 22 of socket 21 after the first injection molding step, with the fastening openings 29 still open.

To seal the wall 28 of the housing 22, a rubber-elastic material 30 is injected into the fastening openings 29 in the second injection molding step. The rubber-elastic material 30 in the fastening opening 29 forms a single seal in the second injection molding step, which extends from the bottom 33 of the plug-in opening 26, parallel to the wall 28 of the plug-in opening 26, and which at least partially encloses (in cylindrical form) the contacts 24 formed in the plug-in opening 26. The seal 34 has a sealing surface 35, formed in the direction of the open end of the plug-in opening 26, which cooperates with a plug that can be inserted into the plug-in opening 26. The sealing surface 35 and the rubber-elastic material 30 in the fastening opening 29 are preferably connected by two extensions arranged in V-shapes relative to each other, made of the same rubber-elastic material 30. These V-shaped extensions can preferably be adjusted inward in a bellows-like fashion when pressure is exerted on the sealing surface 35. The height of the seal 34 is, therefore, optimally adjusted in relation to an inserted plug, and the force against the sealing surface is increased, so that the contact area within the cylindrical seal is well sealed. It is particularly preferred that the end of the seal 34 opposite sealing surface 35 is connected directly to the housing 22 of socket 21, so that, at this location, no additional sealing surface need be formed between the contact area and housing 22.

It is therefore advantageous to form the seal 34 in the second injection molding step, together with sealing the fastening openings 29. In this embodiment, removing the injection molding die from the plug-in opening 26 is straightforward, since the seal 34 consists of rubber-elastic material that can be deformed to allow removal of the injection molding die.

Figure 9:
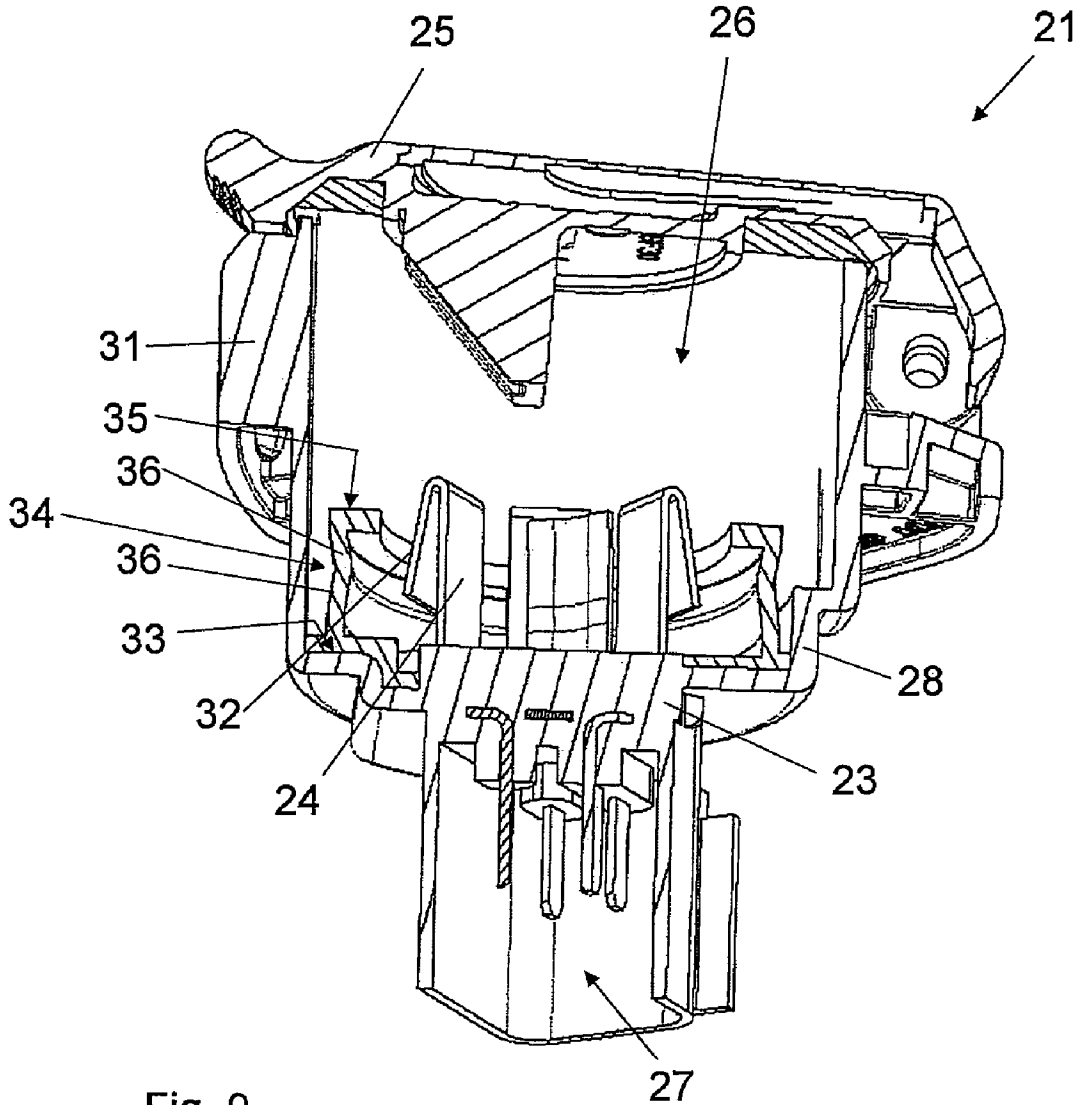
FIG. 9 illustrates a three-dimensional longitudinal section of the second-embodiment socket, sectioned at a 90° angle relative to FIG. 8.

FIG. 9, then, shows a sectional drawing (rotated relative to FIG. 8 by 90°) through a three-dimensional view of the second embodiment socket 21. In FIG. 9, the shape of the contacts 24 and their arrangement in the plug-in opening 26 and the connection opening 27 is easily illustrated. In FIG. 9, the contacts 24 are arranged so that the bent contact surfaces 32 in the plug-in opening 36 form a circle of a total of six contacts 24 (only three of the contacts are shown in the sectional view.) A plug contact is configured in the center (only one side of which is shown). The contacts 24 in the connection opening 27 form two rows of three contacts each, on which a connection plug can be mounted.

The bent contacts cannot typically be inserted into corresponding openings of a contact support insert. The presently disclosed method, therefore, wherein the contacts are cast together with the housing 22 and the contact support insert 23 in a first injection molding step, is therefore particularly advantageous.

Also as shown in FIG. 9, the seal 34 covers the entire bottom 33 of the plug-in opening 26, and surrounds the contacts 24 in the described cylindrical fashion in the section. No fastening openings 29 are formed in the seal.

Figure 10:
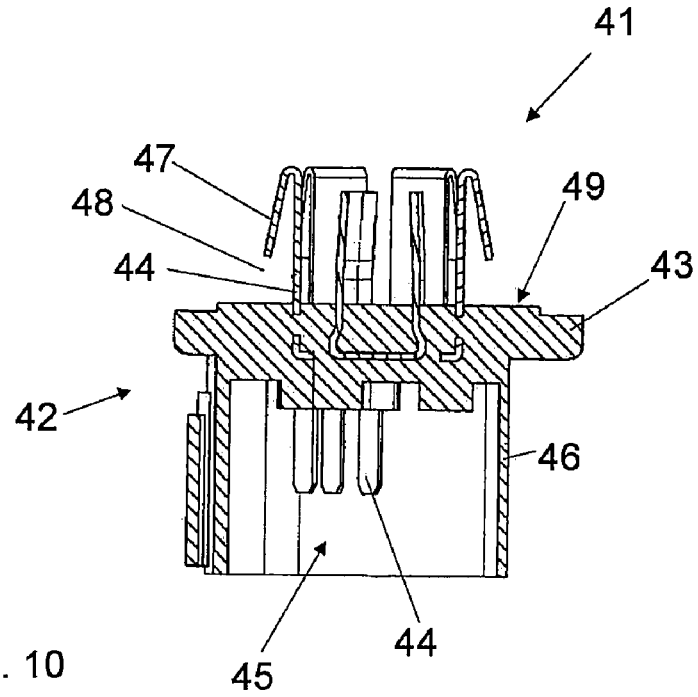
FIG. 10 illustrates a longitudinal section through a third embodiment of the presently disclosed socket, after a first injection molding step.
Figure 11:
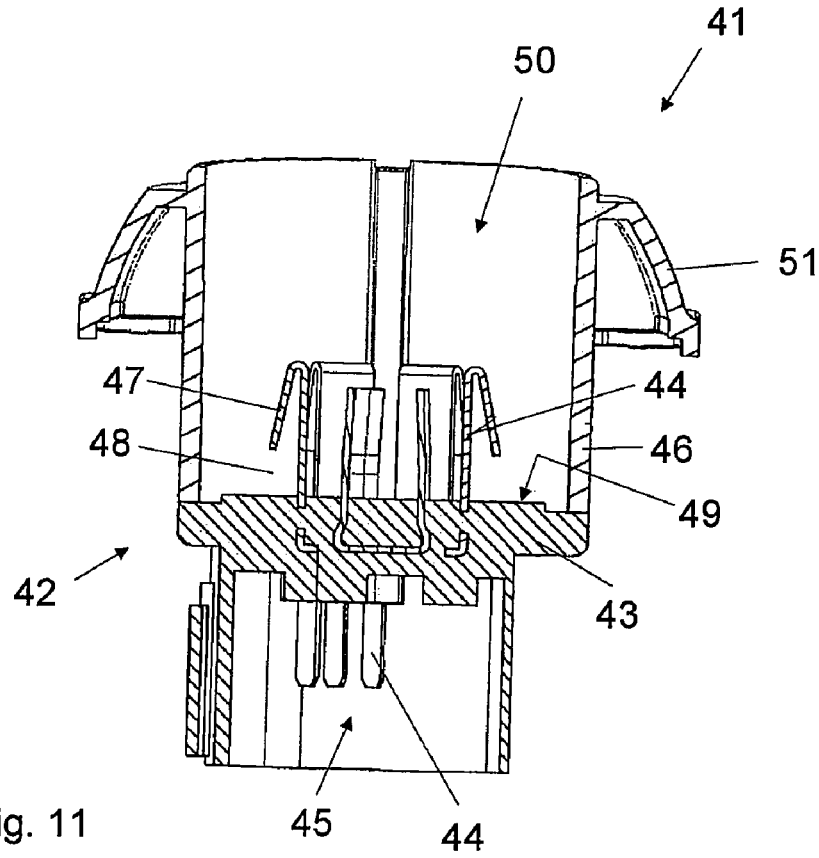
FIG. 11 illustrates a longitudinal section through the socket of FIG. 10 after a second injection molding step.

In FIGS. 10 and 11, a third embodiment of the presently disclosed technology is shown, comprising a socket 41. FIG. 10 illustrates a sectional drawing through the socket 41 after the first injection molding step. FIG. 11 shows a sectional drawing through the socket 41 in a second injection molding step.

In the first injection molding step, a first part of the housing 42 of the socket 41 and a contact support insert 43 are cast in one piece. Contacts 44 are then fixed in the contact support insert 43. The first part of the housing 42 encloses a connection opening 45, up to which the contacts 44 extend. The connection opening 45 is formed by the wall 46 of the housing 42, which extends from the contact support insert 43 in one direction.

In the opposite direction, the contacts 44 protrude from the contact support insert 43, and have an elastically bent contact surface 47. A gap 48 is provided between the end of contact surface 47 and the bottom 49 of the contact support insert 43. This gap 48 forms at the bottom of the plug-in opening 50 (see FIG. 11), where the injection molding die (not shown) fixes the contacts 44 during the first injection molding step. After the first injection molding step, this die can be simply removed to the side.

In the second injection molding step, the second part of the housing 42 is then molded onto the first part of the housing 42 near the contact support insert 43. This second housing part also has a wall 46, which forms the plug-in opening 50 for insertion of a plug (not shown) into the socket 41. A fastening section 51 is formed around the plug-in opening 50, with which the socket 41 can be fastened to a mounting surface. For injection molding of the wall 46 forming the plug-in opening 50, a sleeve can be simply positioned around the contacts 44 with the contact surfaces 47 as an injection molding die, which can be easily removed after the second injection molding step.

Similar to the above-described embodiments, the socket 41 can have a cover for closing the plug-in opening 49 and/or a seal accommodated in the plug-in opening 49, which can be injected into the plug-in opening in another injection molding step with rubber-elastic material. The first two injection molding steps preferably use the same injection molding material.

With the preferred two-step injection molding process of the present technology, a socket 1, 21 can therefore be produced in simple fashion, with contacts 4, 24 that are established in a contact support insert 3, 23, all of which is reliably sealed against moisture penetration.

List of reference numbers:

1 Socket
2 Housing
3 Contact support insert
4 Contact
5 Cover
6 Plug-in opening
7 Connection opening
8 Wall
9 Fastening opening
10 Fastening flange
11 Contact surface
12 Bottom of plug-in opening
13 Gap
14 Injection molding material
21 Socket
22 Housing
23 Contact support insert
24 Contact
25 Cover
26 Plug-in opening
27 Connection opening
28 Wall
29 Fastening opening
30 Rubber-elastic material
31 Fastening section
32 Contact surface
33 Bottom of the plug-in opening

34 Seal
35 Sealing surface
36 Connector
37 Gap
41 Socket
42 Housing
43 Contact support insert
44 Contact
45 Connection opening
46 Wall
47 Elastically bent contact surface
48 Gap
49 Bottom
50 Plug-in opening
51 Fastening section

What is claimed:

1. A socket for an electrical plug-and-socket connection, comprising:

(a) a housing having a plug-in opening for mating with a plug;

(b) a contact support insert positioned in the housing; and (d) flat contacts with an elastically bent contact surface extending into the plug-in opening, which are fixed in the contact support insert only by the material of the contact support insert, wherein a first part of the housing and the contact support insert are comprised of the same material as a single component, and a second part of the housing is fixed to the first part of the housing, and further wherein the socket is produced in two consecutive injection molding steps so that the first part of the housing and the contact support insert with fixed contacts are produced during a first injection molding step, and the second part of the housing is molded onto the first part of the housing in a second injection molding step.

2. The socket of claim 1, wherein the first part of the housing comprises a connection opening and a contact support insert with contacts fastened into it, and the second part of the housing comprises a plug-in opening.

3. The socket of claim 1, wherein the first part of the housing comprises a connection opening, a contact support insert with contacts fastened in it, and a plug-in opening with fastening openings, and wherein the second part of the housing comprises material sealing the fastening openings.

4. The socket of claim 3, wherein the fastening openings are provided on the end of the plug-in opening of the socket, arranged axially in the wall of the housing enclosing the plug-in opening.

5. The socket of claim 3, wherein said fastening openings correspond to each contact.

6. The socket of claim 3, wherein the contacts have contact surfaces that are bent outward towards the wall of the housing, the gaps remain between the end of the contact surfaces and the bottom of the plug-in opening, wherein the height of the gaps correspond approximately to the height of the fastening openings.

7. The socket of claim 3, wherein the material that is used to form the housing and contact support insert in the first injection molding step is the same as the material that is introduced to the fastening opening in the second injection molding step.

8. The socket of claim 3, wherein a rubber-elastic material is introduced to the fastening openings in the second injection molding step.

9. The socket of claim 8, wherein the rubber-elastic material forms an axial seal that seals the contacts relative to a plug inserted into the plug-in opening.

10. The socket of claim 9, wherein the axial seal extends from the fastening opening as a single component configured along the wall around the plug-in opening, and forms a sealing surface on its end opposite the fastening opening.

11. The socket of claim 10, wherein the axial seal has at least two V-shaped extensions configured between the fastening opening and sealing surface.

12. An intermediate component for use in a process for injection molding a socket for an electrical plug-and-socket connection, comprising:

(a) a housing;

(b) a contact support insert positioned in the housing, with flat contacts with an elastically bent contact surface that extend into the plug-in opening and are fixed in the contact support insert only by the material of the contact support insert; and (c) fastening openings for engaging injection molding gates, wherein the housing and the contact support insert with fixed contacts are comprised from the same material as a single component during a first injection molding step.

* * * * *